US006412578B1

(12) United States Patent
Baird

(10) Patent No.: US 6,412,578 B1
(45) Date of Patent: Jul. 2, 2002

(54) BORING APPARATUS

(75) Inventor: Billy Carr Baird, Sturgis, KY (US)

(73) Assignee: DHDT, Inc., Sturgis, KY (US)

( * ) Notice: Subject to any disclaimer, the term of this patent is extended or adjusted under 35 U.S.C. 154(b) by 0 days.

(21) Appl. No.: 09/761,985

(22) Filed: Jan. 17, 2001

Related U.S. Application Data

(63) Continuation-in-part of application No. 09/643,306, filed on Aug. 21, 2000.

(51) Int. Cl.[7] ..... E21B 7/08
(52) U.S. Cl. ..... 175/75; 175/78; 175/82
(58) Field of Search ..... 175/19, 21, 61, 175/62, 67, 73, 75, 78, 79, 81, 82

(56) References Cited

U.S. PATENT DOCUMENTS

| | | | |
|---|---|---|---|
| 1,367,042 | A | 2/1921 | Granville |
| 1,485,615 | A | 3/1924 | Jones |
| 1,733,311 | A | 10/1929 | McNeill |
| 2,065,436 | A | 12/1936 | Ervin |
| 2,251,916 | A | 8/1941 | Cross |
| 2,271,005 | A | 1/1942 | Grebe |
| 2,345,816 | A | 4/1944 | Hays |
| 2,521,976 | A | 9/1950 | Hays |
| 2,608,384 | A | 8/1952 | Alexander |
| 3,191,697 | A | 6/1965 | Haines |
| 3,262,508 | A | 7/1966 | Price |
| 3,536,151 | A | 10/1970 | Aarup |
| 3,670,831 | A | 6/1972 | Winter, Jr. et al. |
| 3,838,736 | A | 10/1974 | Driver |
| 3,840,079 | A | 10/1974 | Williamson |
| 3,853,185 | A | 12/1974 | Dahl et al. |
| 3,873,156 | A | 3/1975 | Jacoby |
| 3,958,649 | A | 5/1976 | Bull et al. |
| 4,007,797 | A | 2/1977 | Jeter |
| 4,168,752 | A | 9/1979 | Sabol |
| 4,185,705 | A | 1/1980 | Bullard |
| 4,317,492 | A | 3/1982 | Summers et al. |
| 4,365,676 | A | 12/1982 | Boyadjieff et al. |
| 4,368,786 | A | 1/1983 | Cousins |
| 4,397,360 | A | 8/1983 | Schmidt |
| 4,445,574 | A | 5/1984 | Vann |
| 4,497,381 | A | 2/1985 | Dickinson, III et al. |
| 4,526,242 | A | 7/1985 | Mathieii et al. |
| 4,527,639 | A | 7/1985 | Dickinson, III et al. |
| 4,533,182 | A | 8/1985 | Richards |
| 4,589,499 | A | 5/1986 | Behrens |
| 4,601,353 | A | 7/1986 | Schuh et al. |
| 4,631,136 | A | 12/1986 | Jones, III |
| 4,640,362 | A | 2/1987 | Schellstede |
| 4,763,734 | A | 8/1988 | Dickinson et al. |

(List continued on next page.)

FOREIGN PATENT DOCUMENTS

| | | |
|---|---|---|
| DE | 0485867 | 10/1929 |
| FR | 0702530 | 4/1931 |
| FR | 1289136 | 2/1962 |
| FR | 2091931 | 1/1972 |
| FR | 2232669 | 3/1975 |

*Primary Examiner*—Roger Schoeppel
(74) *Attorney, Agent, or Firm*—Wood, Herron & Evans, L.L.P.

(57) ABSTRACT

Apparatus for boring a hole from an inside of a casing outwardly at an angle relative to a longitudinal axis of the casing comprises a drill shoe having a longitudinal axis and being positionable in the casing, the shoe having first and second passageways which converge into a third passageway exiting the shoe, a torsional load transmitting element and a cutting element connecting to one end of the torsional load transmitting element, the torsional load transmitting element and cutting element being positioned in the first passageway during non-use and in the third passageway during use, and a fluid conduit and a nozzle connected to one end of the fluid conduit, the fluid conduit and nozzle being positioned in the second passageway during non-use and in the third passageway during use.

14 Claims, 6 Drawing Sheets

U.S. PATENT DOCUMENTS

| | | | | |
|---|---|---|---|---|
| 4,765,173 | A | * | 8/1988 | Schellstede |
| 4,832,143 | A | | 5/1989 | Kaalstad et al. |
| 4,832,552 | A | | 5/1989 | Skelly |
| 4,836,611 | A | | 6/1989 | El-Saie |
| 4,848,486 | A | | 7/1989 | Bodine |
| 4,850,440 | A | | 7/1989 | Smet |
| 4,854,400 | A | | 8/1989 | Simpson |
| 4,880,067 | A | | 11/1989 | Jelsma |
| 4,890,681 | A | | 1/1990 | Skelly |
| 4,928,757 | A | | 5/1990 | Schellstede et al. |
| RE33,660 | E | | 8/1991 | Jelsma |
| 5,090,496 | A | | 2/1992 | Walker |
| 5,113,953 | A | | 5/1992 | Noble |
| 5,148,880 | A | | 9/1992 | Lee et al. |
| 5,165,491 | A | | 11/1992 | Wilson |
| 5,183,111 | A | | 2/1993 | Schellstede |
| 5,228,809 | A | * | 7/1993 | Yoshida et al. |
| 5,373,906 | A | | 12/1994 | Braddick |
| 5,425,429 | A | | 6/1995 | Thompson |
| 5,439,066 | A | | 8/1995 | Gipson |
| 5,622,231 | A | | 4/1997 | Thompson |
| 6,125,949 | A | | 10/2000 | Landers |
| 6,263,984 | B1 | * | 7/2001 | Buckman |

* cited by examiner

BORING APPARATUS

RELATED APPLICATIONS

This application is a continuation-in-part of my co-pending application Ser. No. 09/643,306 filed Aug. 21, 2000 which is hereby incorporated by reference herein as if fully set forth in its entirety.

FIELD OF THE INVENTION

This invention relates broadly to the boring of a hole through the wall of a tube from the inside of the tube outwardly at an angle to a longitudinal axis of the tube. More specifically, this invention relates to apparatus for drilling through an oil or gas well casing at an angle to the longitudinal axis of the casing and into the earth strata surrounding the well casing. More particularly, this invention relates to an improved such drilling apparatus and to a means of transporting, deploying and retrieving the drilling apparatus.

BACKGROUND OF THE INVENTION

Oil and gas wells are drilled vertically down into the earth strata with the use of rotary drilling equipment. A tube known as a casing is placed down into the well after it is drilled. The casing is usually of made of mild steel and is in the neighborhood of 4.5 inches to 8 inches in external diameter (4 inches in internal diameter and up) and defines the cross-sectional area of the well for transportation of the oil and gas upwardly to the earth surface. However, these vertically extending wells are only useful for removing oil and gas from the terminating downward end of the well. Thus, not all of the oil and gas in the pockets or formations in the surrounding earth strata, at the location of the well depth, can be removed. Therefore it is necessary to either make additional vertical drillings parallel and close to the first well, which is costly and time consuming, or to provide some means to extend the original well in a radial direction relative to the vertical longitudinal axis of the casing horizontally into the surrounding earth strata.

The most common means for horizontal extension of the well has been to drill angularly through the well casing at a first 45° angle for a short distance and then to turn the drill and drill at a second 45° angle thereby making a full 90° angular or horizontal cut from the vertically extending well. These horizontal drills have proved useful for extending the well horizontally but have proved to be relatively expensive.

Another solution to the problem is disclosed in U.S. Pat. Nos. 5,413,184 and 5,853,056, both of which are hereby incorporated by reference herein as if fully set forth in their entirety. In these patents there is disclosed an apparatus comprising an elbow, a flexible shaft or so-called "flex cable" and a ball cutter attached to the end of the flexible shaft. The elbow is positioned in the well casing, and the ball cutter and flexible shaft are passed through the elbow, turning 90°. A motor rotates the flexible shaft to bore a hole in the well casing and surrounding earth strata with the ball cutter. The flexible shaft and ball cutter are then removed and a flexible tube with a nozzle on the end thereof is passed down the well casing, through the elbow and is directed out of the casing through the hole therein. Water pumped through the flexible tube exits the nozzle at high speed and bores further horizontally into the earth strata.

Prototype testing of the device disclosed in U.S. Pat. Nos. 5,413,184 and 5,853,056 has proven less than satisfactory. In particular, a number of problems plague the device disclosed in U.S. Pat. Nos. 5,413,184 and 5,853,056. For example, the disclosed ball cutter is inefficient at best and ineffective at worst in cutting through the well casing. The inherent spherical geometry of a ball cutter causes it "walk" or "chatter" during rotation as it attempts to bore through the well casing which greatly increases the amount of time required to bore through the casing. Ball cutters are best utilized for deburring, and/or cutting a radius in an existing hole or slot for example. and are simply not suitable for drilling holes.

Another problem is the torsional flexibility of the flexible shaft or flex cable. Rather than transmitting rotational displacement to the ball cutter at 100% efficiency the flex cable tends to "wind up" or exhibit "backlash," thus reducing the already inefficient cutting efficiency of the ball cutter even more.

Yet another problem is the tendency of the elbow to back away from the hole in the casing during drilling with the ball cutter. Such backing away causes the elbow outlet to become misaligned with the hole in the casing thereby preventing smooth introduction of the nozzle and flexible tube into the hole in the casing.

Still another problem is the large amount of torsional friction generated between the elbow passageway and the flex cable which of course increases the horsepower requirements of the motor required to rotate the flex cable. The addition of balls, separated by springs, to the flex cable, in an effort to alleviate the resistance of the apparatus to being rotated, has not remedied this problem.

A further problem is the closed nature of the apparatus of U.S. Pat. Nos. 5,413,184 and 5,853,056, which prevents its being taken apart, inspected, cleaned and repaired as needed.

The invention of my application Ser. No. 09/643,306 overcomes the deficiencies of the apparatus disclosed in U.S. Pat. Nos. 5,413,184 and 5,853,056. That invention is apparatus for boring a hole from an inside of a tube outwardly perpendicular to a longitudinal axis of the tube. The apparatus comprises a drill shoe having a longitudinal axis and being positionable in the tube, the shoe having an inlet, an outlet perpendicular to the shoe longitudinal axis and a passageway connecting the inlet and outlet, a torsional load transmitting element having no torsional flexibility in relation to its bending flexibility, having a longitudinal axis and being disposed in the passageway, the torsional load transmitting element being movable relative to itself about first and second perpendicular axes both of which are perpendicular to the longitudinal axis of the torsional load transmitting element, a hole saw connected to one end of the torsional load transmitting element and a motor rotatably connected to the other end of the torsional load transmitting element. Rotation of the torsional load transmitting element by the motor rotates the hole saw to bore through the tube from the inside of the tube outwardly perpendicular to the longitudinal axis of the tube.

Further improvements in boring technology are nonetheless desired. For example, the invention of U.S. Pat. Nos. 5,413,184 and 5,853,056 is inefficient and time consuming to operate in that after the cutting tool has bored through the well casing the drilling operation must be interrupted so that the entire drilling apparatus can be retrieved to the earth surface in order to remove the well casing cutting tool and to install the earth strata boring water nozzle. The drilling apparatus must then be lowered back down into the well casing to resume the drilling operation.

SUMMARY OF THE INVENTION

The invention includes apparatus for boring a hole from an inside of a casing outwardly at an angle relative to a longitudinal axis of the casing. The apparatus comprises a drill shoe having a longitudinal axis and being positionable in the casing, the shoe having first and second passageways which converge into a third passageway exiting the shoe, a torsional load transmitting element and a cutting element connected to one end of the torsional load transmitting element, the torsional load transmitting element and cutting element being positioned in the first passageway during non-use and in the third passageway during use, and a fluid conduit and a nozzle connected to one end of the fluid conduit, the fluid conduit and nozzle being positioned in the second passageway during non-use and in the third passageway during use.

The third passageway may exit the shoe at any desired angle of between 0° and 90° relative to the longitudinal axis of the drill shoe. The angle may be, for example, 75° or 90°. The apparatus may include an exit insert installable in the shoe to provide variability in the exit angle.

The torsional load transmitting element has a longitudinal axis, and preferably has no torsional flexibility in relation to its bending flexibility and is movable relative to itself about first and second perpendicular axes both of which are perpendicular to the longitudinal axis of the torsional load transmitting element. The torsional load transmitting element may be freely movable relative to itself about the first and second perpendicular axes. The torsional load transmitting element may be pivotable relative to itself about the first and second perpendicular axes. The torsional load transmitting element may be freely pivotable relative to itself about the first and second perpendicular axes.

The cutting element may be a hole saw. The apparatus may further comprise a drill bit connected to the end of the torsional load transmitting element centrally of the hole saw. The drill shoe may be fabricated in halves. The torsional load transmitting element may comprise a plurality of interconnected universal joints. The shoe may include an angled end surface adapted to cooperate with a matingly angled end surface of a drill shoe depth locator for locating the shoe at a selected depth in the casing such that an angular orientation of the shoe relative to the casing is establishable by positioning the depth locating device at an angular orientation relative to the casing.

A drill shoe depth locator for locating a drill shoe at a selected depth in a casing comprises a housing, at least one locking arm pivotally connected to the housing and an actuator for selectively pivoting the arm. The arm is pivotable to and between a retracted non-locking position in the housing and an extended locking position wherein at least a portion of the arm projects out of the housing and is adapted to contact a wall of the casing.

The actuator for selectively pivoting the arm may comprise a firing mechanism which fires a charge that propels the arm to the extended locking position. The firing mechanism may include a chamber adapted to accept a charge cartridge, a gas path between the chamber and the pivoting arm and a firing pin which is selectively activatable to strike the charge cartridge. The housing may include an angled end surface adapted to cooperate with a matingly angled end surface of the drill shoe such that an angular orientation of the drill shoe relative to the casing is establishable by positioning the depth locator at an angular orientation relative to the casing.

A tool for deploying a drill shoe depth locator in the casing comprises a housing, at least one locking arm pivotally connected to the housing and an actuator for selectively pivoting the arm. The arm is pivotable to and between a retracted non-locking position in the housing and an extended locking position wherein at least a portion of the arm projects out of the housing and is adapted to engage a surface of the drilling apparatus depth locator.

The actuator may comprise a rod movable longitudinally relative to the housing which cooperates with a cam surface on the pivoting arm to thereby move the arm.

A tool for retrieving a drill shoe depth locator from a casing comprises a housing, at least one locking arm pivotally connected to the housing and a resilient member normally biasing the locking arm to an extended locking position yet permitting upon application of sufficient force the locking arm to move to a retracted non-locking position. The arm is pivotable to and between the retracted non-locking position in the housing and an extended locking position wherein at least a portion of the arm projects out of the housing and is adapted to engage a surface of the drill shoe depth locator.

A mobile drilling apparatus comprises a wheeled trailer having a trailer bed, a drill shoe, a mast mounted on the trailer bed for suspending therefrom the drill shoe. a first reel rotatably mounted on the trailer bed for paying out and taking up a cable connected to the drill shoe, the cable supported by the mast, a second reel rotatable mounted on the trailer bed for paying out and taking up a first length of tubing which communicates fluid from a fluid source to a fluid motor in the drill shoe, the tubing supported by the mast, and a third reel rotatably mounted on the trailer bed for paying out and taking up a second length of tubing which communicates fluid from a fluid source to a fluid nozzle in the drill shoe, the tubing supported by the mast.

The mast may be pivotally mounted to the trailer bed for pivoting movement to and between an upright operable position and a lowered inoperable position. The mast may be mounted to a work platform and the work platform may be mounted to the trailer bed for movement transverse to a longitudinal axis of the trailer bed. The apparatus may further comprise a catwalk extending the length of the trailer bed on one side thereof and mounted to the trailer bed for pivoting movement to and between an upright inoperable position and a lowered operable position wherein the catwalk extends the width of the trailer bed. The catwalk may include a set of steps secure thereto such that when the catwalk is in the lowered operable position an operator may climb the steps from a ground surface to the trailer bed.

The apparatus may further comprise a motor rotatably driving each of the first, second and third reels, a brake mounted to each of the first, second and third reels, a sensor mounted to each of the first, second and third reels for sensing an angular velocity of each of the first, second and third reels and a controller which controls the brakes in response to signals received from the sensors. The apparatus may further include a sensor mounted on the mast for sensing a depth traversed by the drill shoe.

These and other advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF THE INVENTION

Figure 1:
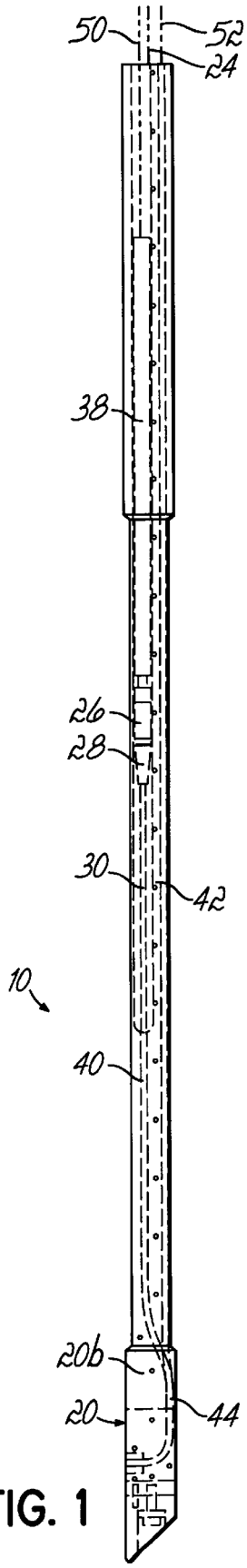
FIG. 1 is a side view of a drill shoe of the invention.
Figure 2:
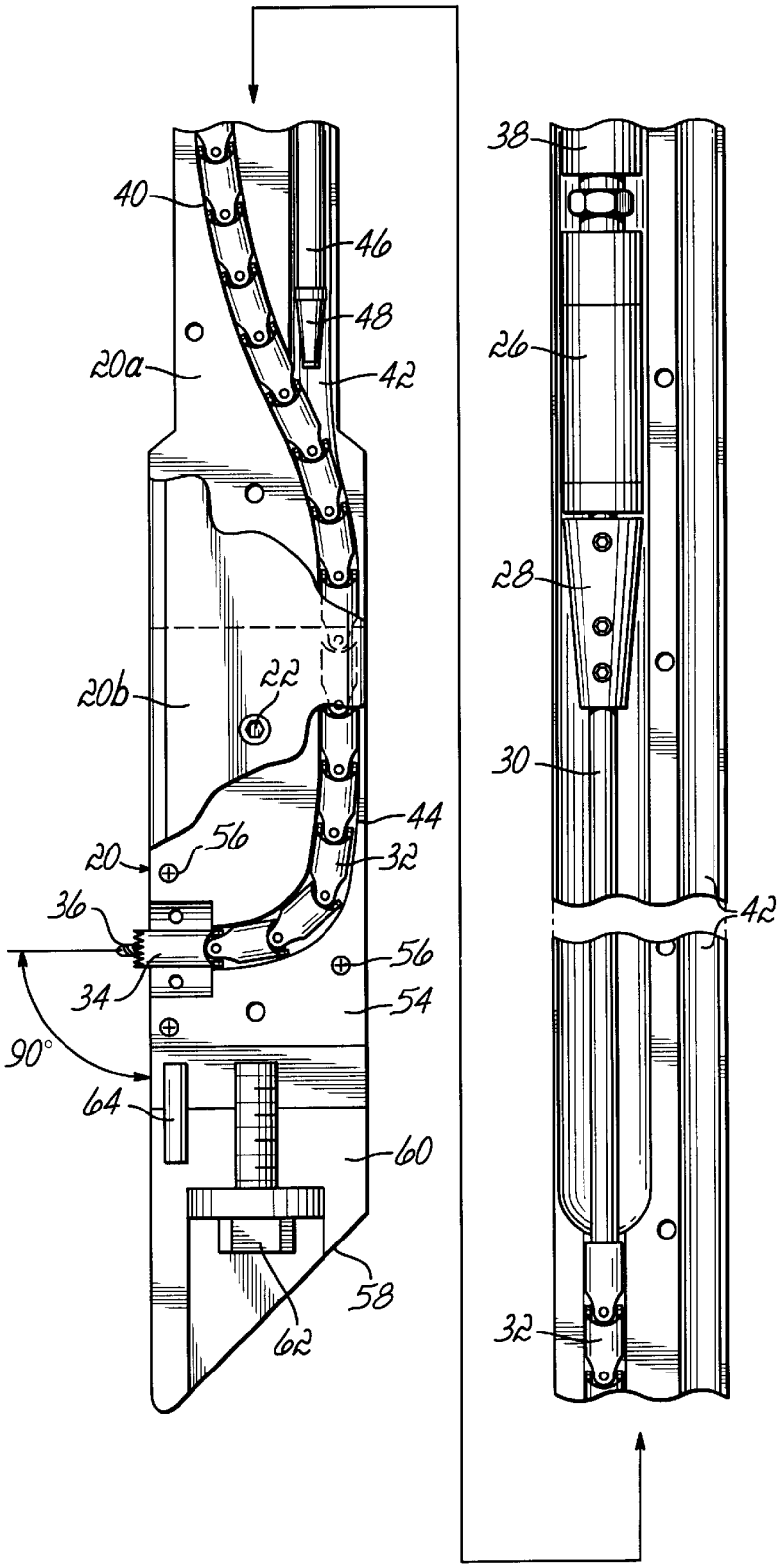
FIG. 2 is an enlarged sectional side view of a portion of the drill shoe of FIG. 1.
Figure 3:
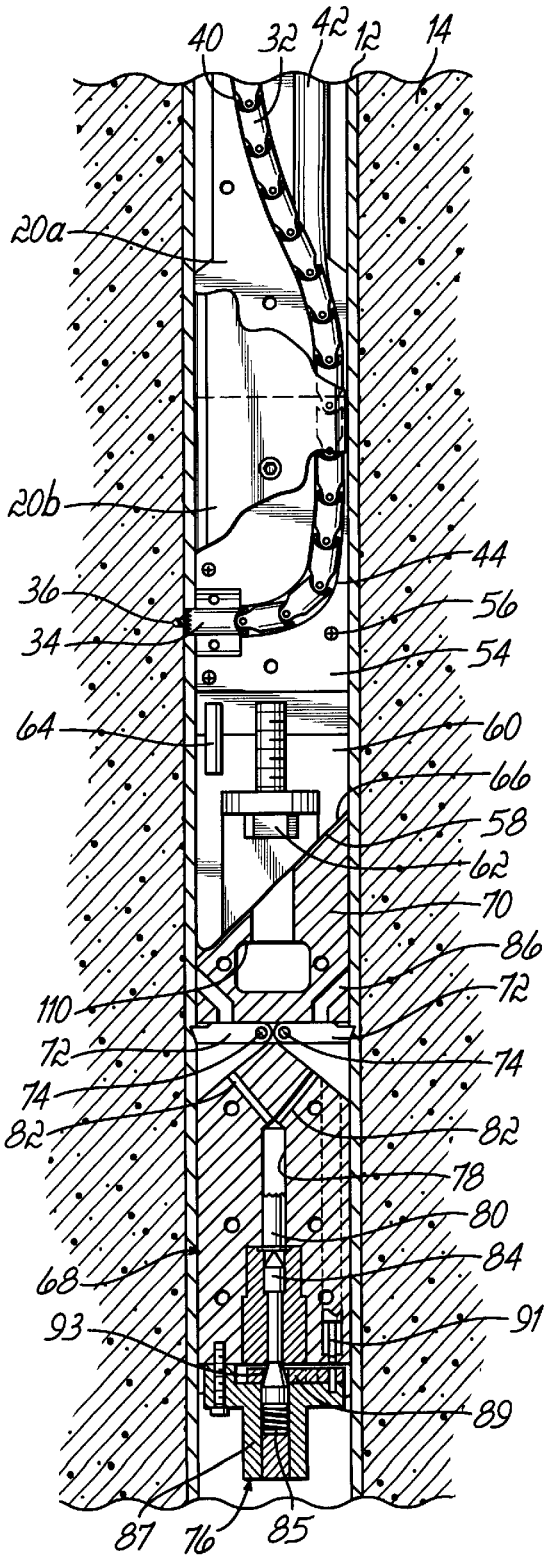
FIG. 3 is a side view in partial cross section of the cooperatingly matingly angled end surfaces of the drill shoe and drill shoe depth locator.

Referring first to FIG. 1 a boring apparatus 10 according to the principles of the present invention is illustrated. During use apparatus 10 is positionable inside a well casing 12 in the earth strata 14 (FIG. 3). The boring apparatus 10 includes a hollow carbon steel drill shoe 20. Drill shoe 20 has a longitudinal axis which, when inserted into casing 12, is generally parallel to a longitudinal axis of the well casing 12. Drill shoe 20 may preferably be fabricated in halves 20*a*, 20*b* securable together via bolts 22. Drill shoe 20 may be connected to a ½ inch diameter 6×25 IWRC wire rope 24 which is utilized to lower drill shoe 20 down into casing 12.

A fluid motor 26 imparts rotation to a motor coupling 28 which is connected to a drill bit shaft 30 itself connected to a plurality of interconnected universal joints 32 which terminate in a hole saw 34 with central pilot hole drill bit 36. Above motor 26 is a motor locator 38; motor locator 38 and drill shoe 20 include cooperating structure (not shown, see U.S. patent application Ser. No. 09/643,306 for same) rotatably fixing the motor locator 38 and hence motor 26 relative to the shoe 20 thereby preventing relative rotation between motor 26 and shoe 20 during operation of motor 26.

Shoe 20 further includes a first passageway 40, a second passageway 42 and a third passageway 44. The universal joints 32, hole saw 34 and drill bit 36 reside in first passageway 40 during nonuse and in third passageway 44 during use. Similarly, a flexible fluid conduit 46 with a nozzle 48 connected to its end is positioned in the second passageway 42 during nonuse and in the third passageway 44 during use. Motor 26 may be suspended from and supplied with liquid through a ½ inch diameter 0.049 inch wall thickness 316L stainless steel tubing 50. Similarly, fluid conduit 46 may be suspended from and supplied with liquid through a ⅝ inch diameter 0.049 inch wall thickness 316L stainless steel tubing 52.

Figure 4:
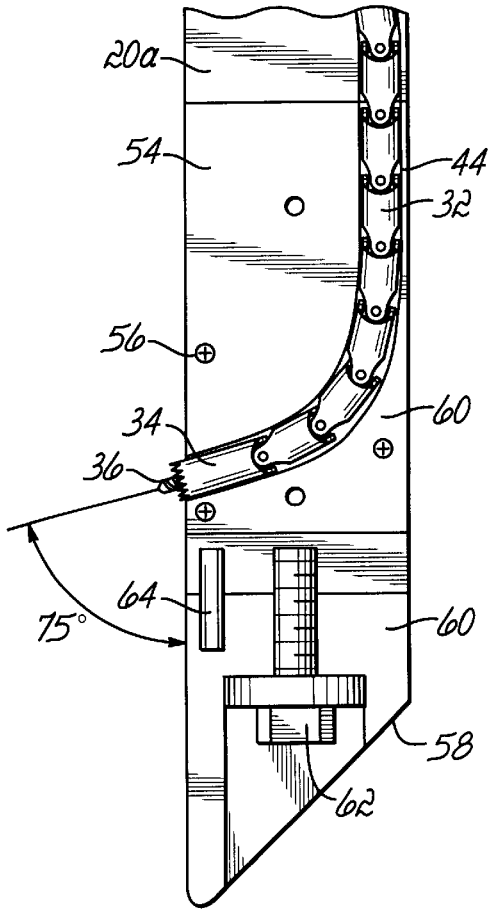
FIG. 4 is an enlarged view of the end of the drill shoe with angle locating surface.

Third passageway 44 may exit the shoe 20 at any desired angle of between 0° and 90° relative to the longitudinal axis of the shoe 20, depending on the drilling application. Preferably, the angle is in the general range of about 75° to 90°. To provide convenient variability and versatility in the exit angle of the third passageway 44 one of a number of exit angle inserts 54 may be utilized, each of which inserts would include a different exit angle. For example, two exit inserts 54 may employed, one of which is at 75° (FIG. 4) and the other of which is at 90° (FIG. 3) thereby providing an operator with a ready means of quickly changing the exit angle depending on drilling conditions etc. Exit insert 54 may be removably installable in the shoe 20 via screws 56.

Referring to FIGS. 1–4, shoe 20 may include an angled end surface 58 formed as part of an angular locator 60 secured to a lower end of shoe 20 with a bolt 62 and locating pin 64. Angled end surface 58 is adapted to cooperate with a matingly angled end surface 66 of a drill shoe depth locator 68 (discussed in more detail below) for locating the shoe 20 at a selected depth in the casing 12. An angular orientation of the shoe 20 relative to the casing 12 is establishable by positioning the depth locator 68 at an angular orientation relative to the casing 12. The matingly angled end surfaces 58 and 66 automatically determine the angular orientation of the shoe 20 to locator 68 and thus shoe 20 to casing 12. The use thereof will be described below in more detail.

Figure 5:
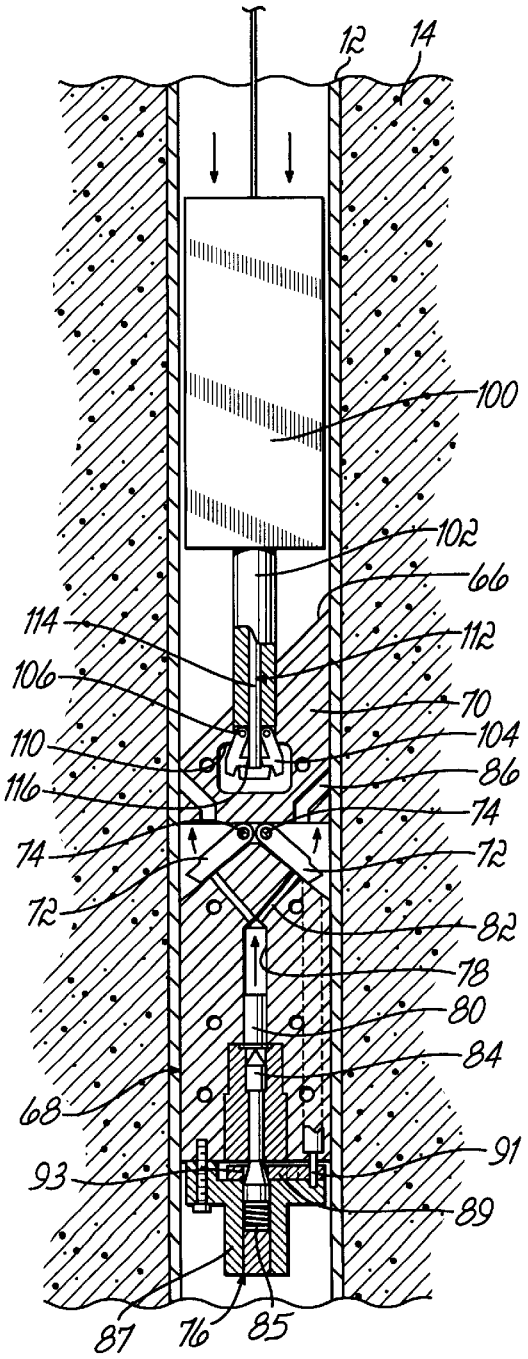
FIG. 5 is a side cross-sectional view of a device for locating the drill shoe at a selected depth in the casing, and a tool for deploying the drill shoe depth locator.
Figure 6:
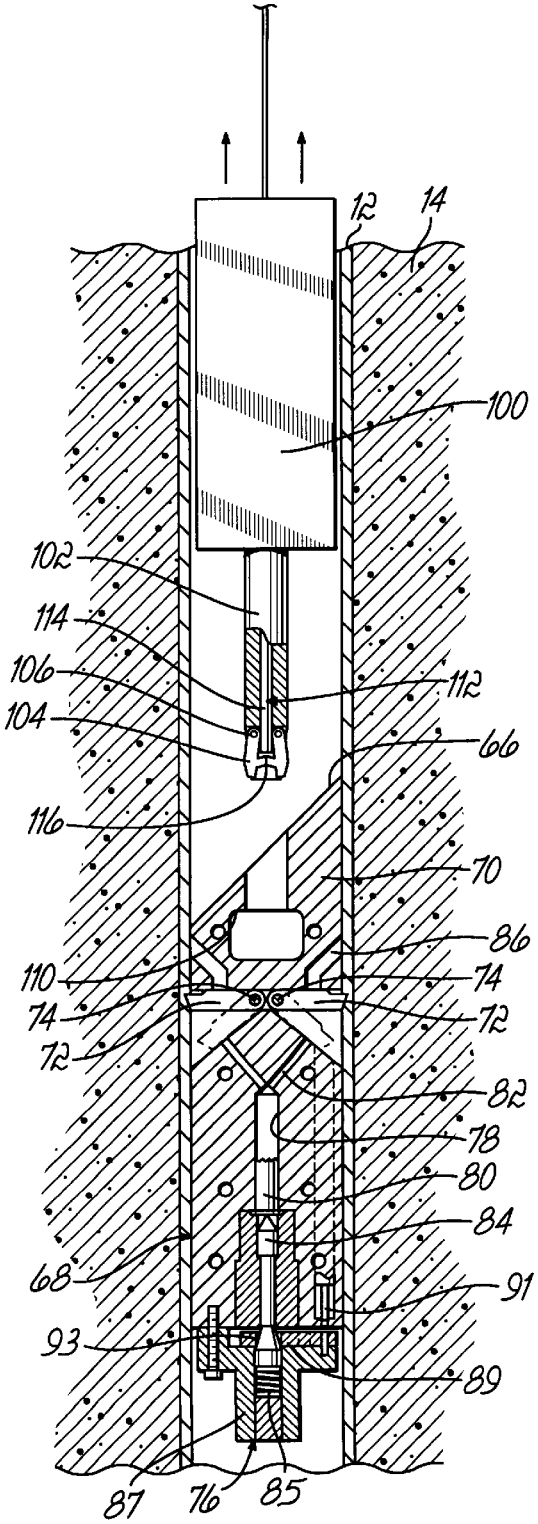
FIG. 6 is a view similar to FIG. 5 with the drill shoe depth locator fixed in position in the casing and the deploying tool being withdrawn from the casing.

Referring now to FIGS. 3, 5 and 6, the drill shoe depth locator 68 is illustrated which locates the drill shoe 20 at a selected depth in the casing 12. The depth locator 68 comprises a housing 70 and may preferably comprise a pair of locking arms 72 pivotally connected to the housing 70 as by pivots 74. The arms 72 are pivotable to and between a retracted nonlocking position in the housing (FIG. 5) and an extended locking position wherein at least a portion of the arms 72 project out of the housing 70 and is adapted to contact the wall of the casing 12. An actuator 76 may be included for selectively pivoting the arms 72. The actuator 76 may comprise a firing mechanism, which fires a charge that propels the arms 72 to the extended locking position, which comprises a chamber 78 adapted to accept a charge cartridge 80. a gas path 82 between the chamber 78 and each pivoting arm 72 and a firing pin 84 which is selectively activatable to strike the charge cartridge 80 thus releasing combustion gases which force the arms 72 upwardly into a locking position relative to the casing 12. Gas vent paths 86 bleed excess gas out of housing 70. Preferably the firing mechanism actuator 76 of the device 68 would be activated as the device 68 is being lowered into the casing 12; when the device 68 reaches the desired depth as indicated by, for example, a rotary encoder, the mechanism 76 is fired propelling the arms 72 upwardly into engagement with the casing 12, the downward momentum of the device 68 further assisting in locking the arms 72 into the wall of the casing 12. In the alternative, the charge cartridge 80 and firing pin 84 could be eliminated; the locking arms 72 can be forced upwardly into engagement with the casing 12 by simply lowering locator 68 at a sufficient velocity such that water in casing 12 moves forcefully up chamber 80 through paths 82 and into contact with arms 72 forcing them upwardly.

Firing pin 84 is spring loaded via compression spring 85 positioned within firing pin housing 87. A firing pin blocking plate 89 normally blocks firing pin 84 from upward movement. Firing pin blocking plate 89 is maintained in its blocking position via a release rod 91. Upon upward movement of release rod 91 aperture 93 in blocking plate 89 centers around firing pin 84 thereby freeing firing pin 84 to move upwardly under force of compression spinrg 85.

As mentioned briefly above, the depth locator 68 preferably includes an angled end surface 66 which cooperates with the matingly angled end surface 58 of the drill shoe 20. Once the device 68 is in position in the casing 12, a plurality of radially extending horizontal borings can be made into the earth strata by adjusting the angular position of the angular locator 60 relative to the shoe 20, it being contemplated that the shoe 20 and locator 60 would have a plurality of locating pins 64 positioned at, for example 5° to 1020 increments. Thus, with each 5° or 10° readjustment of locator 60 relative to shoe 20, the shoe 20 can bore a new radial path radially outwardly from the casing 12 but at a known increment relative to the previous boring. If desired, the shoe 20 and locator 60 can be repeatedly readjusted to drill radially outwardly from the well casing 12 in a full 360° circle.

Referring still to FIGS. 5 and 6, there is illustrated a tool 100 for deploying the drill shoe depth locator 68 in the casing 12. The tool 100 comprises a housing 102 and a pair of locking arms 104 pivotally connected to the housing 102 as by pivots 106. The locking arms 104 are pivotal to and between a retracted non-locking position (FIG. 6) generally within the periphery of the housing 102 and an extended locking position (FIG. 5) wherein at least a portion of the arms 104 project out of the housing 102, and are adapted to engage a surface 110 of the depth locator 68. An actuator 112 selectively pivots the arms 104 to and between the retracted non-locking position (FIG. 6) and the extended locking position (FIG. 5). The actuator preferably comprises a rod 114 which is movable longitudinally relative to the housing 102 and which cooperates with a cam surface 116 on each pivoting arm 104 to thereby move the arms 104. Thus, to lower the depth locator 68 in the well casing 12, the tool 100 is engaged with the depth locator 68 in that the rod 114 is in a downward position forcing arms 104 outwardly so as to engage underneath surface 110 of the device 68. Once the depth locator 68 is at the desired depth in the casing 12, the rod 114 is pulled upwardly thereby permitting upward force on the tool 100 to force the pivoting arms 104 inwardly and free of surface 110 thus permitting the tool 100 to be withdrawn from the casing 12.

Figure 7:
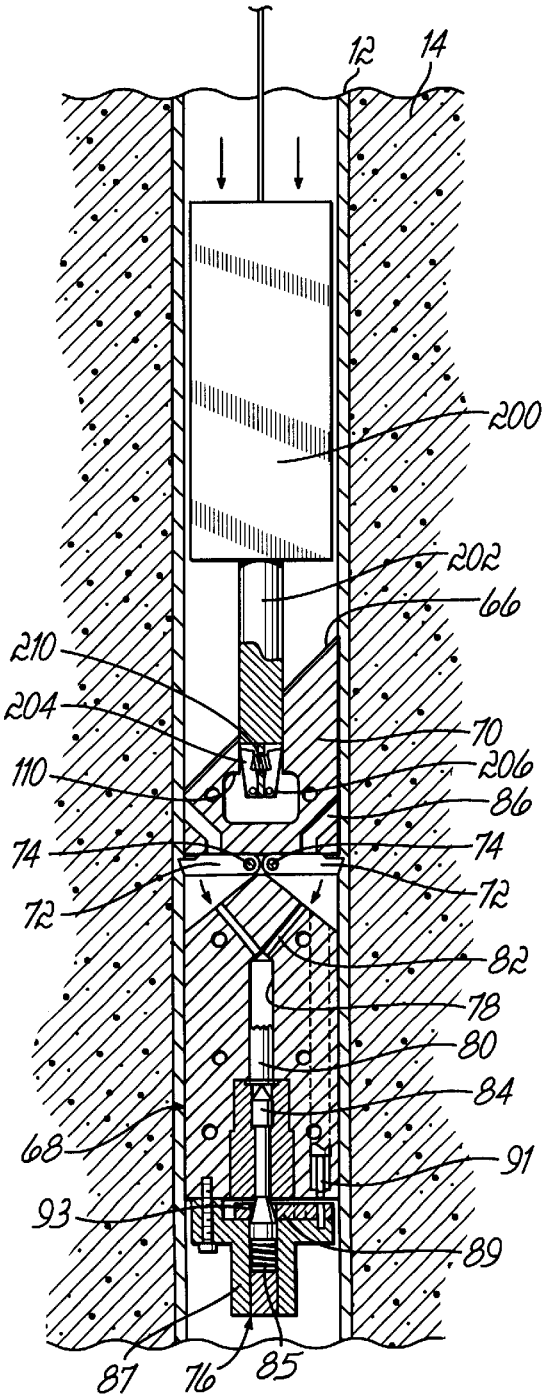
FIG. 7 is a view similar to FIG. 5 but of a tool for retrieving the drill shoe depth locator engaging the drill shoe depth locator.
Figure 8:
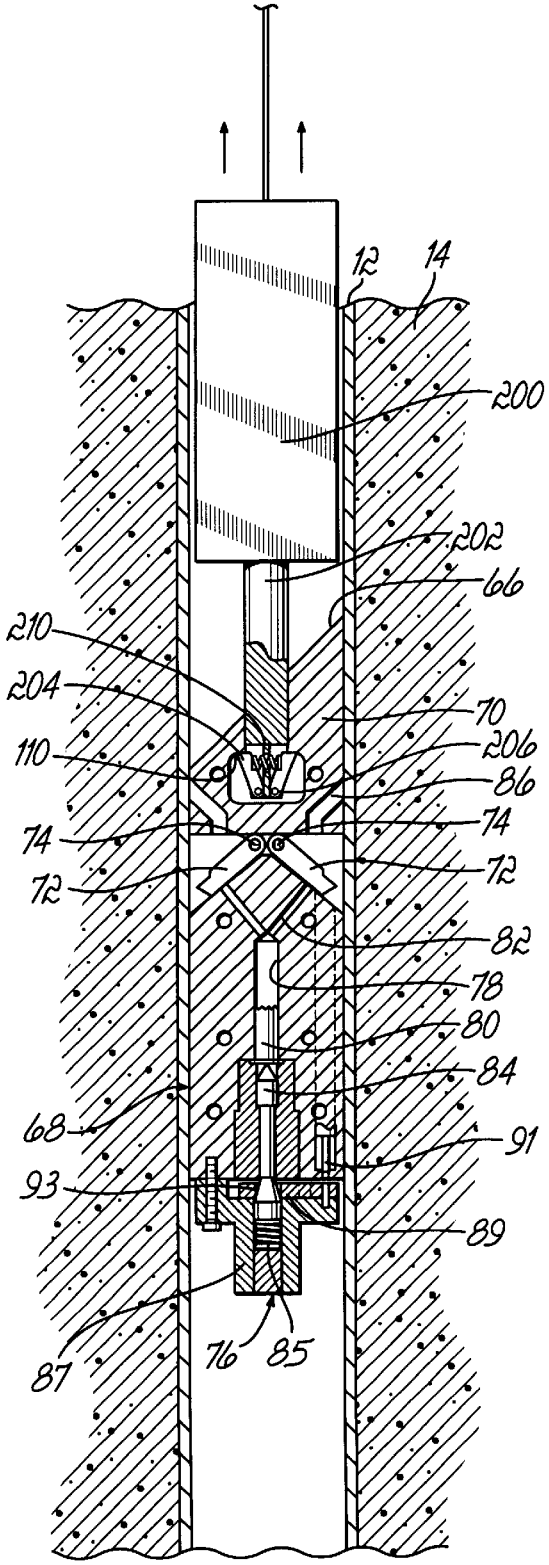
FIG. 8 is a view similar to FIG. 7 of the retrieving tool and drill shoe depth locator being withdrawn from the casing.

Referring now to FIGS. 7 and 8 there is illustrated a tool 200 for retrieving the depth locator 68 from the casing 12. The tool 200 comprises a housing 202 and a pair of locking arms 204 pivotally connected to the housing 202 as by pivots 206. The locking arms 204 are pivotable to and between a retracted non-locking position (FIG. 7) generally within the periphery of the housing 202 and an extended locking position (FIG. 8) wherein a portion of the arms 204 project out of the housing 202 and are adapted to engage the prior mentioned surface 110 of the depth locator 68. A resilient member 210 normally biases the locking arms 204 to the extended locking position, yet permits upon application of a sufficient force the locking arms 204 to move to the retracted non-locking position, i.e. during initial insertion of housing 202 and locking arms 204 into depth locator 68 (FIG. 7).

Figure 9:
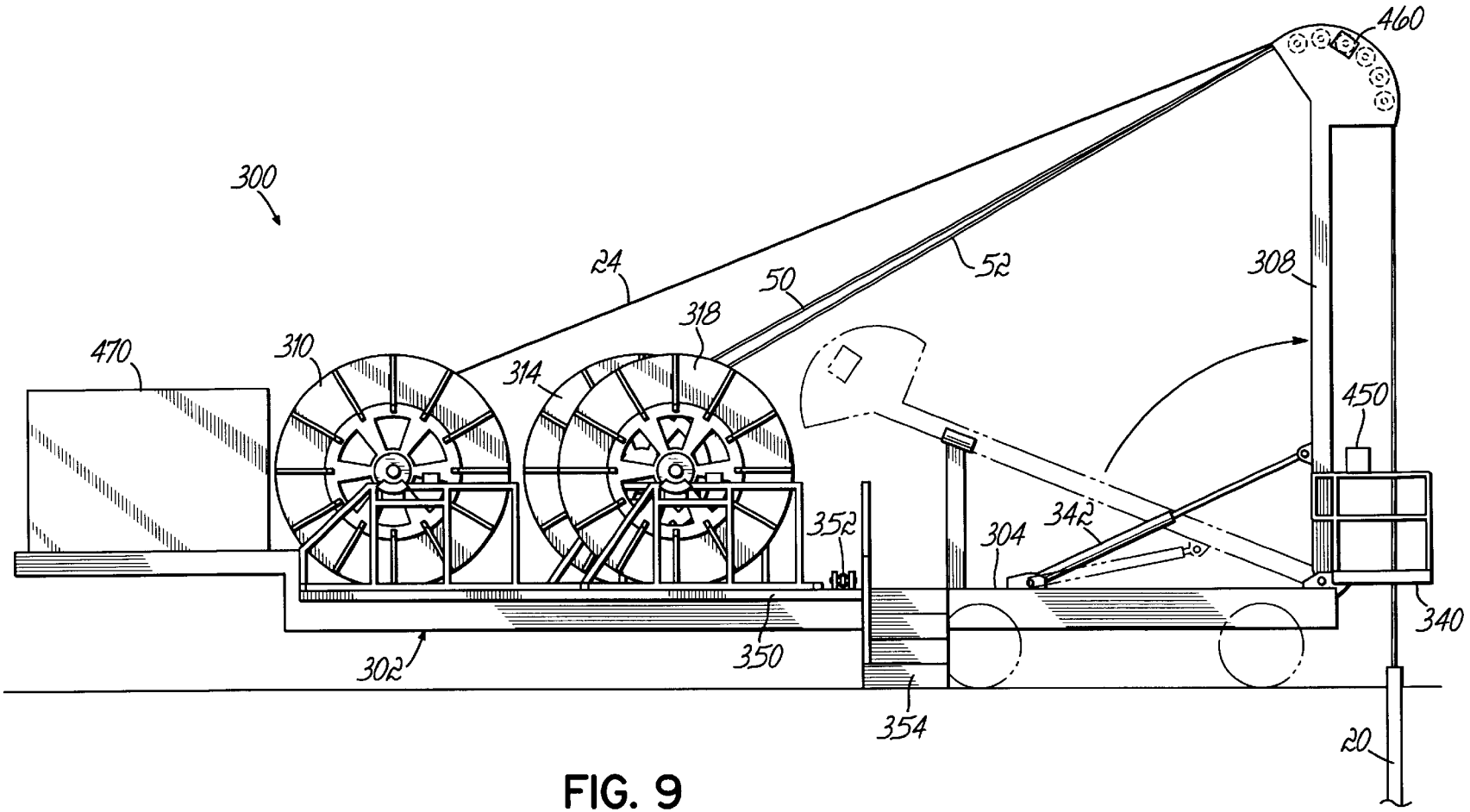
FIG. 9 is a side view of the mobile drilling apparatus of the invention.
Figure 10:
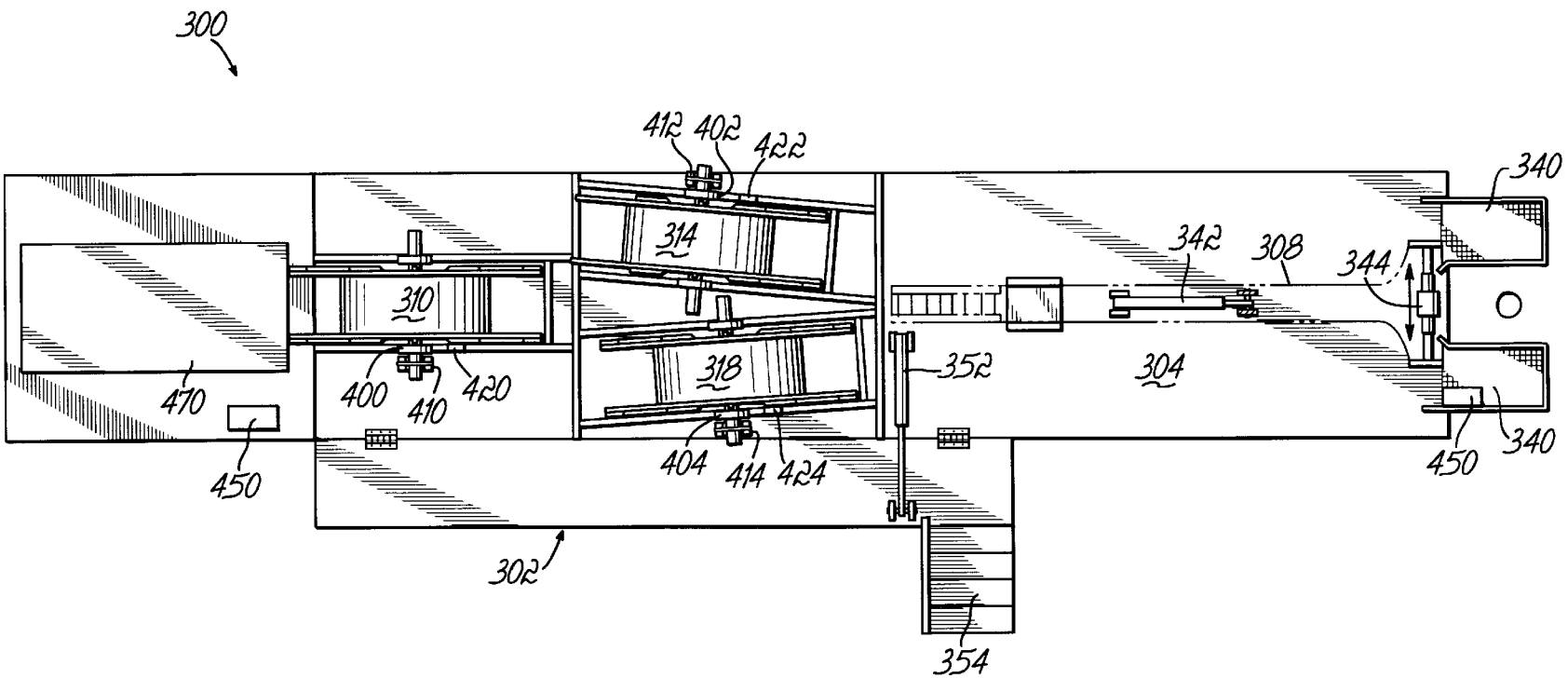
FIG. 10 is a top view of the mobile drilling apparatus of FIG. 9.

Referring to FIGS. 9 and 10 a mobile drilling apparatus 300 is illustrated. The apparatus 300 comprises a wheeled trailer 302 having a trailer bed 304, the prior described drill shoe 20, a mast 308 mounted on the trailer bed 304 for suspending therefrom the drill shoe 20, a first reel 310 rotatably mounted on the trailer bed 304 for paying out and taking up cable 24 connected to the drill shoe 20, the cable 24 being supported by the mast 308, a second reel 314 rotatably mounted on the trailer bed 304 for paying out and taking up the first length of tubing 50 which communicates fluid from a fluid source (not shown) to the fluid motor 26 in the drill shoe 20. the tubing 50 supported by the mast 308, and a third reel 318 rotatably mounted on the trailer bed 304 for paying out and taking up the second length of tubing 52 which communicates fluid from the fluid source to the fluid nozzle 48 in the drill shoe 20, the tubing 52 supported by the mast 308. Reels 310, 314 and 318 may be five feet in diameter and capable of storing up to ten thousand feet of wire rope or tubing.

The mast 308 is preferably mounted to a work platform 340. Work platform 340 is preferably mounted to the trailer bed 304 for pivoting movement of the mast 308 to and between an upright operable position and a lowered inoperable position, and is also mounted to the trailer bed 304 for movement transverse to a longitudinal axis of the trailer bed 304 thereby providing transverse alignment of drill shoe 20 to casing 12. Hydraulic cylinder 342 may be operable between the trailer bed 304 and mast 308 to pivot the mast 308 relative to the bed 304. Hydraulic cylinder 344 may be operable between the work platform 340 and trailer bed 304 to move the work platform 340 transversely to the longitudinal axis of the trailer bed 304.

Trailer 302 may additionally comprise a catwalk 350 extending along the trailer 302 on one side thereof and mounted to the trailer bed 304 for pivoting movement to and between an upright inoperable position and a lowered operable position wherein the catwalk 350 extends the width of the trailer bed. A hydraulic cylinder 352 may be operable between the bed 304 and catwalk 350 to pivot the catwalk 350 and between the upright inoperable and lowered operable positions. Catwalk 350 may include a set of steps 354 secured thereto such that when the catwalk 350 is in the lowered position an operator may climb the steps from a ground surface to the trailer bed 304.

With reference to FIG. 10 the apparatus may further preferably comprise hydraulic motors 400, 402 and 404 rotatably driving each of the reels 310, 314 and 318 respectively at up to 8 rpm, hydraulic disk brakes 410, 412 and 414 mounted to each of the reels 310, 314 and 318 respectively and sensors 420, 422 and 424 mounted to each of the reels 310, 314 and 318 respectively for sensing an angular velocity of each of the reels 310, 314 and 318. A controller 450 is operable to control the brakes 410, 412 and 414 in response to signals received from the sensors 420, 422 and 424 to insure that the cable 20 and tubing 50 and 52 all pay out and are taken back up at the same rate. Controller 450 also includes manually manipulable controls for the reels and brakes. To monitor the distance drill shoe 20 is being lowered into the casing 12 a sensor 460 may be mounted atop mast 308 to sense a depth traversed by the drill shoe 20. Sensors 420, 422, 424 and 460 may take the form of, for example optical rotary encoders. A diesel engine driven 15,000 psi water pump and hydraulic fluid pump 470 supplies high pressure water to motor 26 and nozzle 48 and hydraulic fluid pressure to motors 400, 402, 404, brakes 410, 412, 414 and cylinders 342, 344, 352, respectively.

Those skilled in the art will readily recognize numerous adaptations and modifications which can be made to the present invention which will result in an improved boring apparatus, yet all of which will fall within the spirit and scope of the present invention as defined in the following claims. Accordingly, the invention is to be limited only by the scope of the following claims and their equivalents.

What is claimed is:

1. Apparatus for boring a hole from an inside of a casing outwardly at an angle relative to a longitudinal axis of the casing, said apparatus comprising:

a drill shoe having a longitudinal axis and being positionable in the casing, said shoe having first and second passageways which converge into a third passageway exiting said shoe;

a torsional load transmitting element and a cutting element connected to one end of said torsional load transmitting element, said torsional load transmitting element and cutting element being positioned in said first passageway during nonuse and in said third passageway during use; and a fluid conduit and a nozzle connected to one end of said fluid conduit, said fluid conduit and nozzle being positioned in said second passageway during nonuse and in said third passageway during use.

2. The apparatus of claim 1 wherein said third passageway exits said shoe at an angle of between 0° and 90° relative to said longitudinal axis of said drill shoe.

3. The apparatus of claim 2 wherein said angle is 75°.

4. The apparatus of claim 2 wherein said angle is 90°.

5. The apparatus of claim 2 further including an exit insert installable in said shoe thereby providing variability in said angle.

6. The apparatus of claim 1 wherein said torsional load transmitting element has a longitudinal axis, has no torsional flexibility in relation to its bending flexibility and is movable relative to itself about first and second perpendicular axes both of which are perpendicular to said longitudinal axis of said torsional load transmitting element.

7. The apparatus of claim 6 wherein said torsional load transmitting element is freely movable relative to itself about said first and second perpendicular axes.

8. The apparatus of claim 6 wherein said torsional load transmitting element is pivotable relative to itself about said first and second perpendicular axes.

9. The apparatus of claim 8 wherein said torsional load transmitting element is freely pivotable relative to itself about said first and second perpendicular axes.

10. The apparatus of claim 1 wherein said cutting element is a hole saw.

11. The apparatus of claim 10 further comprising a drill bit connected to said one end of said torsional load transmitting element centrally of said hole saw.

12. The apparatus of claim 1 wherein said drill shoe is fabricated in halves.

13. The apparatus of claim 1 wherein said torsional load transmitting element comprises a plurality of interconnected universal joints.

14. The apparatus of claim 1 wherein said shoe includes an angled end surface adapted to cooperate with a matingly angled end surface of a drill shoe depth locator for locating the shoe at a selected depth in the casing such that an angular orientation of the shoe relative to the casing is establishable by positioning the depth locator at an angular orientation relative to the casing.

* * * * *

UNITED STATES PATENT AND TRADEMARK OFFICE

CERTIFICATE OF CORRECTION

PATENT NO. : 6,412,578 B1
DATED : July 2, 2002
INVENTOR(S) : Baird

It is certified that error appears in the above-identified patent and that said Letters Patent is hereby corrected as shown below:

Column 6,
Line 65, "5° to 1020" should be -- 5° to 10° --.

Signed and Sealed this

Fifteenth Day of March, 2005

JON W. DUDAS
*Director of the United States Patent and Trademark Office*